US006481108B1

(12) United States Patent
Helinski

(10) Patent No.: US 6,481,108 B1
(45) Date of Patent: Nov. 19, 2002

(54) PORTABLE COUNTERBALANCING SYSTEM FOR HANDHELD IMPLEMENTS

(76) Inventor: Edward Frank Helinski, 1502 Oakdale Rd., Johnson City, NY (US) 13790

( * ) Notice: Subject to any disclaimer, the term of this patent is extended or adjusted under 35 U.S.C. 154(b) by 0 days.

(21) Appl. No.: 09/852,539

(22) Filed: May 10, 2001

(51) Int. Cl.[7] ..... B26B 27/00
(52) U.S. Cl. ..... 30/296.1; 224/262
(58) Field of Search ..... 30/296.1, 231; 224/185, 262, 922; 294/59

(56) References Cited

U.S. PATENT DOCUMENTS 3,140,800 A * 7/1964 Henderson ..... 224/174
3,964,182 A * 6/1976 Pomeret et al. ..... 294/49 X
5,213,292 A 5/1993 Evans

OTHER PUBLICATIONS

Sales pamphlet by Saje, (date unknown).

* cited by examiner

*Primary Examiner*—Douglas D. Watts

(57) ABSTRACT

A portable, bodily harnessed counterbalancing system is used to aid the suspension and support of hand held implements and to eliminate or reduce the hand held weight of those implements by transferring all or nearly all weight which would be supported by the operators hands and arms to a body harness which is primarily supported and fastened at the operators waist along with secondary support and fastening to the upper torso.

18 Claims, 4 Drawing Sheets

PORTABLE COUNTERBALANCING SYSTEM FOR HANDHELD IMPLEMENTS

FIELD OF THE INVENTION

The present invention relates to counterbalancing the weight of handheld implements thereby reducing the strain and physical fatigue resulting from the sustained use of implements such as weed cutters, hedge shearers, chain saws, Christmas tree shearers, pole pruners and other similar devices. The present invention makes it possible to increase the operating time and frequency of use of hand held implements as a direct result of decreasing the strain and fatigue associated with the operation of these implements.

Many implements have a weight of about 10 pounds and are suitable for short duration, occasional use; however, more frequent and extended usage of this equipment is tiring especially to the hands, arms and shoulders of the user. The extended and repeated use of these devices may contribute to repetitive motion or stress injury such as carpal tunnel syndrome.

The present invention is useful in suspending and supporting the implement and allowing all the motions required to use the implement while nearly eliminating its handheld weight through the use of a counterbalancing system which supports, and transfers nearly all weight, usually supported by the operators hands and arms, to a body harness which is primarily supported and fastened at the operators waist along with secondary support and fastening to the operators upper torso.

BACKGROUND OF THE INVENTION

The need to support heavy objects which are not readily carried by a person is well known. The backpack has been shown to result in decreasing the effort and increasing the efficiency of carrying loads compared to carrying by hand. The backpack, especially the improved modern versions, has been used to support, suspend and carry loads which sometime exceed 100 pounds although recommended loads are usually one third of the body weight of the individual.

Ancient stationary devices such as the sweep have been used to at least partially counterbalance loads, usually ground water, which is raised manually using a rope attached to one end of a boom which is pivoted above a vertical ground anchored post or mast.

The manufacturing industry has made use of counterbalancing booms to vertically support tools which are used in production . One such mechanism is described in U.S. Pat. No. 5,213,292, issued to Maurice Evans on May 25, 1993. The mechanism disclosed has a swing arm mounted at one end to a fixed column with an articulating arm pivotally mounted at the opposite end of the swing arm. A tool holder is mounted at the distal end of the articulating arm. Springs connected to and extending above the articulating arm counterbalance both the articulating arm and an attached tool holder using a unique method of adjusting the spring tension for use with tools having different weight. This device is satisfactory for manufacturing and assembly work where a permanently anchored, stationary, sturdy and heavy column is available. There is no suggestion or teaching of adapting this device for portable use. Also a large unidirectional bending moment is produced at the column resulting from the weight and position of the entire mechanism including the spring itself making this device unsuitable for portable use.

Another fixed support system has a curved overhead boom rigidly connected to a back pack, extending upward and forward passing overhead and in front of the user. This device has no known patent number but is made by Saje ( registered trademark), a maker of shearing machines for trees. This "custom fit" backpack has a rigid boom having an attached strap which hangs from the extended end of the boom directly in front of the users head for attachment and support of a power driven shearing bar held by the user. This system supports the weight of the shearing bar and allows limited movement fore and aft and left and right due to movement of the short strap; however, the boom is rigid and provides vertical support but does not provide counterbalancing during vertical motion. The attachment strap allows only limited pitch and yaw and provides for only limited rotation.

Another commonly used support for weed-cutters is the over the shoulder sling with an attachment clip which is used to connect the implement at a level near the users waist. This arrangement provides pivotal support at the point of connection: to the implement and allows the implement to be moved in a arcuate pattern but does not provide counterbalancing when the implement is lifted vertically. The sling restricts and impedes movement to the left, right, fore and aft and provides for only limited rotation.

SUMMARY OF THE INVENTION

Aspects of the present invention provide a compliant body harness which is integrally connected to a counterbalancing system which provides vertical counterbalancing over an extended range of vertical motion while allowing a full range of implement manipulation. Counterbalancing is done using a pivotal boom assembly, located over the implement, having a flexible rope or cable connecting the implement to the end of the boom.

The counterbalancing system is arranged so that the lifting support it provides to the implement is nearly vertical and above the implement especially while lifting and extending the implement in the forward direction due to the arcuate movement of the pivoting boom complimenting the arcuate movement of the users arms pivoting about the users shoulders.

Pitch, yaw and rotational movements of the implement are made possible due to a pivotal connection of the implement at the end of the rope and the compliant characteristics of the rope itself. The extended rope allows the implement to be moved fore and aft, as viewed from the operators perspective, as well as left and right and a compliant body harnessing arrangement provides additional movement thereby allowing a complete range of implement movement.

The described combination forms a portable counterbalancing system suitable for supporting devices such as tree shearers, weed-cutters, pole pruners, chain saws as well as other devices. The counterbalancing system, which uses springs to provide the counterbalancing force, reduces the hand held weight of a 10 pound implement to typically no more than 5 percent of the implements weight over the entire operating range of motion which the implement is used. This is accomplished by efficiently transferring approximately 95 percent of the implement weight to the body harness by using an integrally connected counterbalance. Since the implement is held in front of the user, the counterbalance is arranged so that most of the operating mechanism, such as the extension springs used to provide the counterbalancing force, is located behind the user to minimize back rest pressure and force and to transfer as much weight as possible to the users waist. If the spring were located in front of and above the user the springs weight would result in an increased moment which would impose more back rest force against the users back.

A typical overall weight of the described counterbalancing system, including the body harness, is about 5 pounds. This system will result in a hand held weight of no more than ½ pound when used to counterbalance a 10 pound implement over a range of vertical motion of 60 inches. The described system would be said to be under-balanced by ½ pound. This system also allows for over-balancing. An over-balanced condition could be adjusted or set, by altering the spring force, to provide an excess lifting force of 12 ounces with no lifting required by the hands to raise the implement. A condition such as this would require downward hand force to maintain equilibrium but when used for above-the-shoulder lifting would partially compensate for the weight of the users arms thereby reducing the overall operating effort.

The operating characteristics of the device do not result in exact counterbalancing throughout the entire vertical operating range and about 3 ounces of friction is typical. However, proper design and spring adjustment results in near perfect counterbalancing at two positions over the entire operating range with a few ounces of both under-balancing and over-balancing present throughout the remainder of the vertical operating range.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

For a better understanding of the present invention, together with other and further objects, advantages and capabilities thereof, reference is made to the following disclosure and appended claims in connection with the above-described drawings. It is understood that like numerals may be used to indicate like elements from Figure to Figure.

Figure 1:
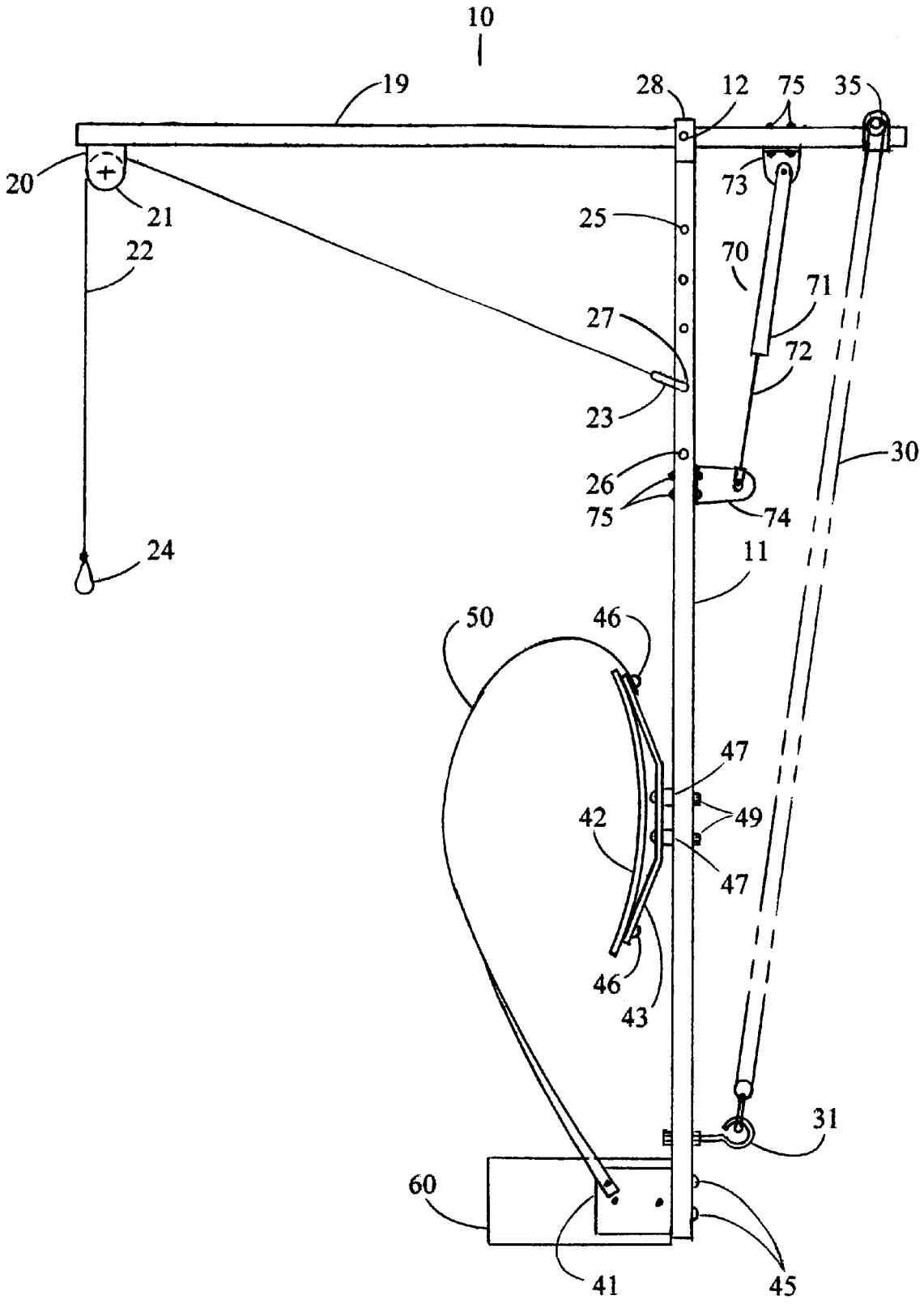
FIG. 1 represents a side elevation view of the portable counterbalancing system constructed in accordance with the invention and positioned with its boom in its horizontal position representing the mid position of pivotal motion.

In FIG. 1 counterbalancing system 10 is integrally connected to a compliant body harnessing system which is attachable to a person. Mast 11 provides support for the counterbalancing system and integrally connects to the components of the body harnessing system which are located on the lower portion of mast 11.

Figure 4:
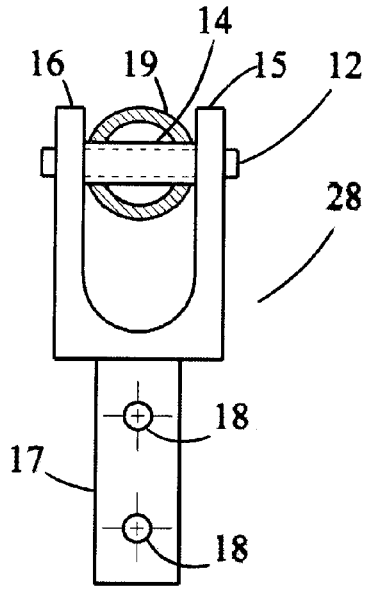
FIG. 4 represents a partial rear elevation view of the pivot and yoke assembly shown in FIG. 1 which attaches to the center mast as viewed with a cut away of the boom assembly.
Figure 7:
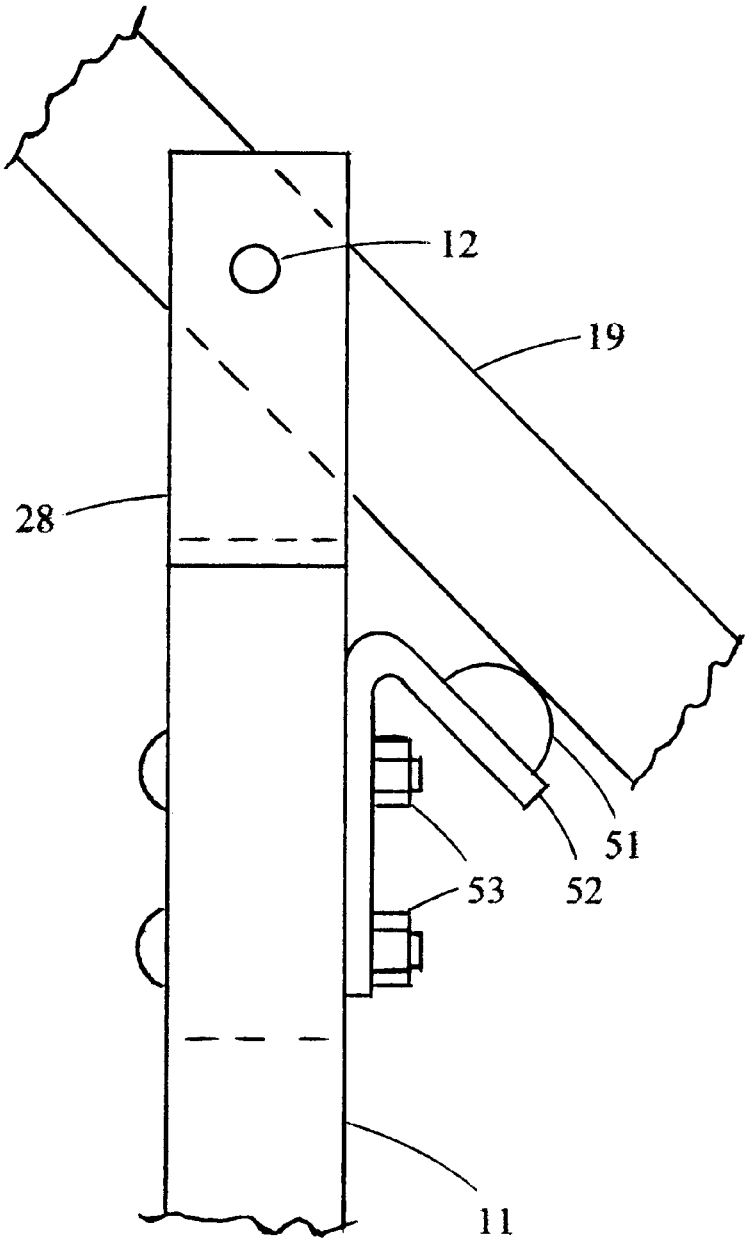
FIG. 7 represents a side elevation view of an alternative bumper stop assembly and its relationship to the boom and mast.

Mast 11 carries an upper pivot shaft 12 shown in FIGS. 1, 4, 7 which rotatably attaches boom 19 to mast 11 shown in FIG. 1 using a yoke assembly 28 supporting pivot shaft 12, having a round shaft 17, which is best viewed in FIG. 4, on the lower portion of yoke assembly 28, fitting into mast 11 and having two holes 18 provided to bolt mast 11 to shaft 17 thereby securing mast 11 to yoke assembly 28.

Boom 19 pivots about pivot shaft 12 and uses an oil impregnated bushing 14 which rotates freely about pivot shaft 12 as shown in FIG. 4.

Bushing 14 may be made of sintered bronze and is press-fitted within a hole in boom 19. Other suitable bearings and materials may be substituted for bushing 14.

Bushing 14 rests between the two uprights 15, 16 of yoke assembly 28 which may be made of aluminum with clearance provided between the ends of bushing 14 and uprights 15, 16 for free rotation of bushing 14 on pivot shaft 12 which is preferably press-fitted into holes within uprights 15, 16.

With reference to FIG. 1, boom 19 extends to the left and right of and is counterbalanced along with the implement about pivot shaft 12. During its operation boom 19 may rotate about plus or minus 45 degrees to all positions both clockwise and counterclockwise from the approximate mid position of travel shown.

Implements such as a tree shearer or weed-cutter or similar devices would be supported below the left side of boom 19 using loop 24 formed at one end of flexible rope or cable 22 that passes over pulley 21 within pulley assembly 20 attached on the left side of boom 19 using nuts and bolts (not shown) for coupling the implement to boom 19.

Figure 6:
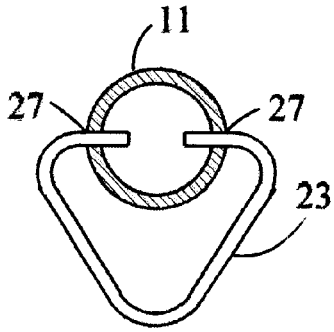
FIG. 6 represents a plan view of the rope attachment bracket as viewed with a cut away view of the mast.

Rope 22 is attached at its opposite end using a knot or other suitable means for fastening to a rope attachment bracket 23 shown in FIGS. 1, 6 which is supported to pivot freely within holes 27 provided in tubular mast 11. Bracket 23 may be formed from round steel rod or other suitable material.

The purpose of the rope and pulley arrangement is to allow increased vertical movement of the implement coupled or connected thereto compared to attaching the rope directly to the boom. An increased or amplified range of vertical motion of the implement using pulleys can be accomplished when it is desired to obtain more vertical motion using a given boom or to decrease the angular motion of the boom for a given vertical motion. For example, a longer boom would allow additional vertical motion than a shorter boom but may be unwieldy and a rope connected to the end of the boom would no longer be connected directly over the implement but instead would connect forward of the implement and operator.

When rope attachment bracket 23 is attached in hole 27 as shown in FIG. 1 the resulting range of vertical motion of an attached implement ( not shown) connected at attachment loop 24 would be more than with the rope attached directly to the end of the boom. Repositioning the rope attachment upward to hole 25 would result in less range of vertical motion while moving rope attachment bracket 23 to hole 26 would allow a greater range of vertical motion. If yet more range of motion is desired a compound pulley arrangement may be used by placing a second pulley assembly (not shown) on mast 11 near hole 26 and connecting a longer rope 22 (not shown) up through this pulley and upward to boom 20 for mounting to the right side of pulley assembly 20 using rope attachment bracket 23 into holes (not shown) provided in boom 19. Other satisfactory and well known compound pulley arrangements may also be used.

Figure 3:
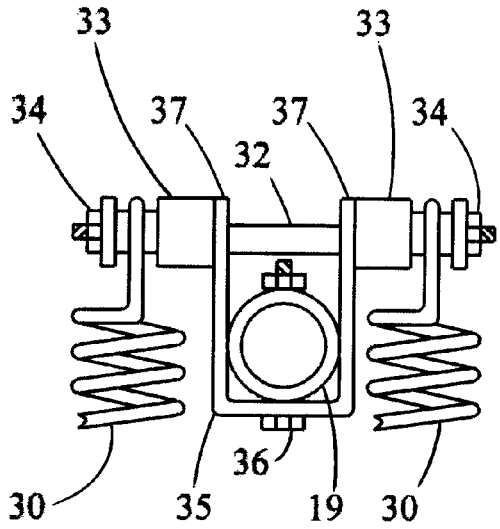
FIG. 3 represents a partial rear elevation view of the spring mounting bracket and its connection to the right end of the boom as shown in FIG. 1.
Figure 5:
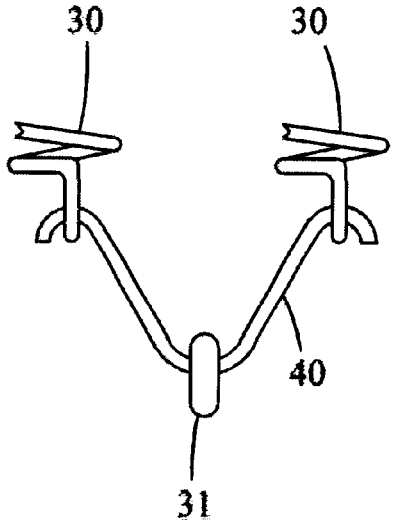
FIG. 5 represents a partial rear elevation view of the lower spring attachment bracket and eyebolt shown in FIG. 1.

One or more extension springs 30 provide the counterbalancing force and moment about pivot shaft 12 necessary to counterbalance and offset the overall effect of both the weight of the implement and the moment it produces due to the length of the boom and to overcome the mechanical advantage provided by the pulley system. Two extension springs 30, which are described in FIGS. 1, 3 and 5 are connected to the right end of boom 19 as viewed in FIG. 1. FIG. 3 describes a U shaped spring mounting bracket 35, shown in FIG. 1, which is fastened to boom 19 using nuts and bolts 36. Spring retaining shaft 32 has threaded ends and passes through two holes in uprights 37 of bracket 35 and retains the end loops of springs 30 with two spacing collars 33 having grooves to accept the end loops of springs 30 and are secured by two nuts 34 which are fastened to the threaded ends of shaft 32.

Springs fabricated from music wire, each having a spring rate of 0.6 pounds per inch have resulted in good operating characteristics; however other suitable spring materials and spring operating characteristics may be used. A single spring design having appropriate dimensions and spring characteristics may also be used.

U shaped bracket 35 may be formed from flat steel stock or other suitable materials. Spring retaining shaft 32 is positioned so that the pivot point of spring 30 is above boom 19. This pivot position has resulted in the best overall counterbalancing throughout the full range of vertical motion of the implement which is typically 60 inches on Christmas tree shearers. With reference to FIGS. 1, 5 the spring loops at the lower ends of springs 30 are connected to the hooked ends of a V shaped spring retainer 40 which connects to an eyebolt 31, which in turn is fastened to mast 11 using the threaded portion of eyebolt 31 and is fastened using nuts. Spring retainer 40 may be formed using round steel rod or other suitable materials.

It can be seen that the two springs 30 are advantageously located to the right of pivot shaft 12 and behind the user ( as shown in FIG. 1 without the user) where their weight assists in counterbalancing the implement which is suspended and supported by rope 22 on the left side of pivot shaft 12 in front of the user.

The body harnessing assembly consists of components, which will be more clearly explained in the following paragraphs, that are shown located to the left of mast 11 as viewed in FIG. 1. An individual, when harnessed, with the implement attached at rope loop 24 feels minimal backrest force from backrest pad 42 as a result of this arrangement.

Other potential positions of springs 30 (not shown), such as when the springs are located above and connected to the left end of boom 11 as viewed in FIG. 1, would result in an increased backrest force being applied to the users back due to the increased moment produced by both the implements weight as well as the springs weight.

The fatigue resulting in the use of implements such as weed-cutters, usually held near waist level for extended periods of time, is also greatly reduced. Without the present invention, the use of weed-cutters for grass and weed trimming over extended periods of use can result in considerable fatigue which may contribute to accident or injury.

The design of the present invention as shown in FIG. 1 is for applications where an extended range of vertical motion is required. Other applications such as for using weed-cutters or metal detectors require only a fraction of the vertical motion described. In such cases the pulley system described would not be required. The rope 22 may be attached at the boom end using an eyebolt along with a common "S" hook (not shown) or may be connected using other suitable means. This would also allow the use of less spring force and in some cases one spring instead of two. The length of boom 19 may also be reduced for typical weed-cutter applications as well as the length as mast 11.

Figure 2:
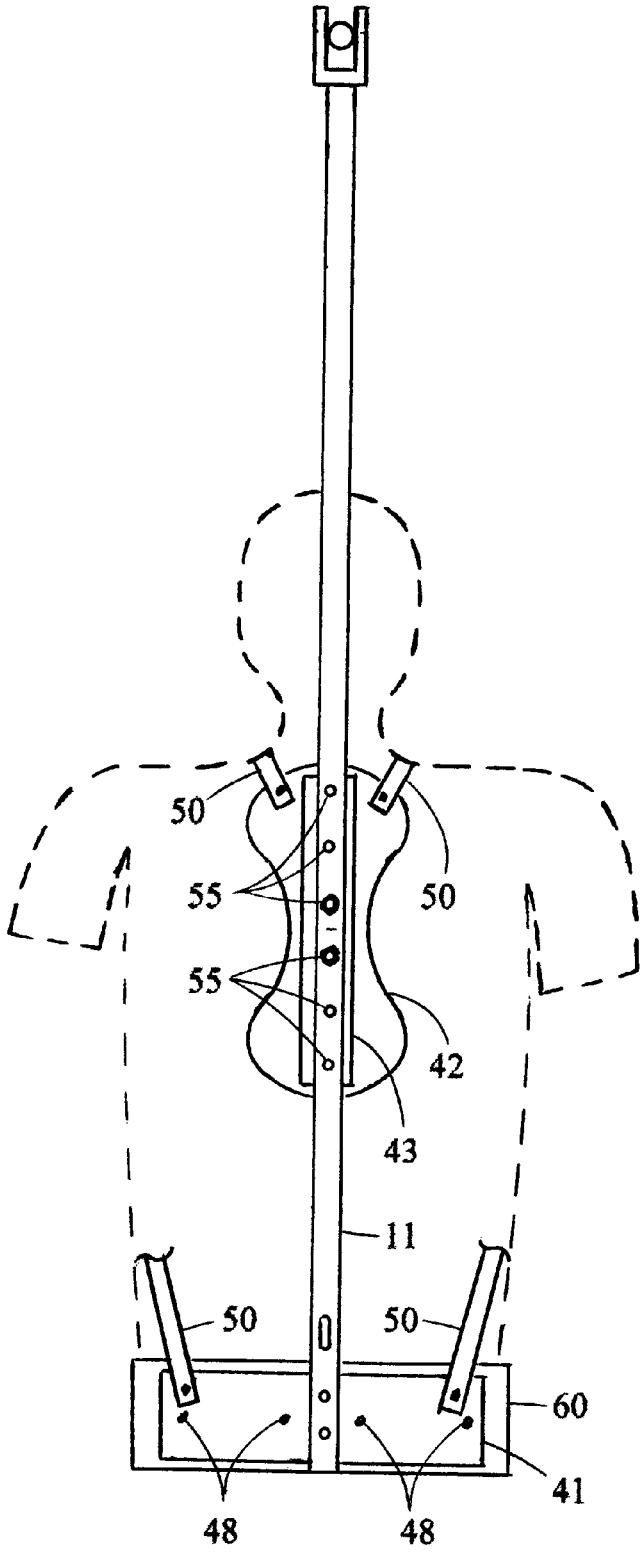
FIG. 2 represents a partial rear elevation view of the portable counterbalancing system described in FIG. 1; with a schematic representation of an individuals partial torso represented by dashed lines.

FIGS. 1 and 2 also describes a method of harnessing and connecting the described counterbalancing system to an individuals body consistent with the objectives of the invention. A wide padded hip belt assembly 60 is shown in FIG. 1 having a side release buckle and dual waist adjustment (not shown) which is commonly found in nearly all conventional present day backpack rigging. Hip belt assembly 60, which passes around and is retained about the users waist, is fastened to a compliant waist belt stiffener 41 near each end and near its center at four points 48, as shown in FIG. 2, using nuts and bolts with strain relief washers (not shown) applied against hip belt assembly 60 to prevent fabric tearing. Waist belt stiffener 41 is about .2 inches thick and may be made of a compliant material which is electrically non conductive such as polyethylene or other suitable materials and is fastened to mast 11 using nuts and bolts 45 as shown in FIG. 1. Waist belt stiffener 41 due to its compliant characteristics allows limited torsional rotation of mast 11, and provides for an increased range of left and right movements of the implement beyond what is provided by rope 22 . The compliant characteristics can be increased by using thinner or softer materials for waist belt stiffener 41 or by using rubber washers between waist belt stiffener 41 and mast 11.

A compliant and adjustable backrest pad 42 is fastened through slotted holes in backrest bracket 43 using nuts and bolts 46 which are preferably made of an electrically non conductive material such as nylon or other suitable insulating material. Backrest bracket 43 is fastened to mast 11 using nuts and bolts 49 with thick resilient washers 47 which provide a compliant mounting between bracket 43 and mast 11.

Bracket 43 can be positioned at different vertical positions along mast 11 using a series of holes 55 as shown in FIG. 2 to enable a good fit for all users. Washers 47 provide compliant support allowing backrest pad 42 to comfortably remain aligned during movements of the users back as well as allowing torsional movement of mast 11. Backrest pad 42 is about 0.2 inches thick and made be made of a compliant material which is electrically non conductive such as polyethylene or other suitable materials and is shown held in a curved shape to conform to the users back using backrest bracket 43.

Backrest bracket 43, which may be made using 0.125 inch thick aluminum, is formed as shown in FIG. 1 but may be bent by the user to comfortably fit and align backrest pad 42 in the position, which best fits the individual users back. Backrest pad 42 as illustrated in FIG. 2 has a substantially hourglass profile, which is designed for distributed pressure against the users back when aligned with its narrowest portion to rest approximately between the users shoulder blades so that movements of the arms, body and shoulder blades do not cause discomfort to the user. FIG. 2 shows a partial view of two shoulder straps 50, shown cut off, which are attached to backrest pad 42 using nuts and bolts.

Shoulder straps 50 shown in FIGS. 1 and 2 pass over and rest against the users shoulders (as shown in the schematic representation of an upper torso in FIG. 2) and may cross each other at or near the users sternum and then connect to waist belt stiffener 41 where they are fastened using nuts and bolts.

Shoulder straps 50 may be made of conventional one inch wide nylon strapping material or other suitable material or material widths and may have conventional side release buckles and adjustable provisions (both not shown) located at or near the buckles with both the buckles and the adjustments within easy reach of the user near the users chest. Belts, buckles and nylon strapping material of the described type are found at conventional backpacking suppliers. An adjustable sternum strap (not shown) may be used as an alternative to crossing the shoulder straps 50 in front of the users chest. The sternum strap may be applied and used in a conventional manner which is commonly done with back packs.

Harnessing is completed by attachment and adjustment of both shoulder belts and hip belt to comfortably fit the users shoulders and waist. Rope 22 may be made of commercially available 5/32 inch diameter nylon rope or other suitable size rope or material with a loop 24 formed at its end using a knot or other suitable means. An attachment hook (not shown) or a commercially available attachment clip may be fastened to the implement (not shown) using a suitable bracket (not shown) to couple the implement to loop 24. The attachment hook may be rigidly, pivotally or rotatably attached to the implement depending on the application. Rotary tree shearers typically require an attachment, which allows the implement to be rotated about 90 degrees in each direction.

For some applications it may be desirable to have 360 degrees of continuous rotation. This may be done using a nylon strap formed into a loop to accept and rotatably support the flexible drive shaft housing of the implement passing within said loop, such as those found on a tree shearer or weed cutter, and having an attachment hook attached to the nylon strap above said loop for attachment to rope loop 24. The implements drive shaft passing within said loop is retained for rotation, preferably near its balance point, using two commercially available shaft collars which may be made of delrin (a Dupont Corp. product), aluminum or other suitable materials and may be fastened in place on each side of the strap forming the loop using set screws provided within the collars.

Weed-cutters require only a small degree of rotation during use and a rigidly mounted or pivoting hook usually provides sufficient rotation.

Pulley assembly 20 may be made using an inverted U shaped housing to contain and pivotally support pulley 21 for rotation on its pivot shaft and may fasten to boom 19 using nuts and bolts.

The pulley pivot shaft (not shown) in pulley assembly 20 may be made of a hardened steel rod press fitted into the described inverted U shaped housing. Pulley 21 may me made of aluminum, steel or other suitable material such as nylon, or other suitable plastics and may have an oil impregnated sintered bronze bearing which rotates on the described pulley pivot shaft.

Boom 19 and mast 11 may be made using tubular aluminum or may be made using fiberglass reinforced tubular material or other suitable plastic or reinforced plastic material, which is strong and lightweight and more suitable for hazardous conditions requiring the use of nonconductive materials. If conductive materials are used, especially for mast 11, the individual should be separated from direct contact through the use of non conductive materials in the harnessing apparatus.

The inadvertent or accidental release of rope 22, which might occur during connection or disconnection of the implement, will result in the boom 19 rotating rapidly clockwise as viewed in FIG. 1. This may ultimately result in damage to the parts involved including the mast, boom or yoke, etc.

In order to prevent this damage a conventional hydraulic damper or shock absorber 70 providing damping may be used to control and limit the motion and velocity of boom 19. Hydraulic damper or shock absorber 70, shown in FIG. 1, having an upper cylinder 71 and lower piston rod 72 is mounted between boom 19 and mast 11 using pivotal mounting brackets 73 and 74 using nuts and bolts 75 or other suitable means. Hydraulic damper or shock absorber 70 would preferably provide unidirectional damping only when boom 19 rotates clockwise during accidental release. The damping system as described, although not necessary for counterbalancing, would slow the motion of the mechanism upon accidental release and prevent the sudden stop and damage when boom 19 reaches its end of travel.

The present invention may use tensile gas springs, having similar geometry as hydraulic damper 70, to assist or substitute for extension springs 30 and may be mounted on the right side of mast 11 in the same manner as described for shock absorber 70. A tensile gas spring having internal unidirectional damping may be used alone or combined with conventional extension springs to provide the counterbalancing force necessary to support an implement and slow the motion of the mechanism upon accidental release.

An alternative air dashpot (not shown) may be connected using similar pivotal mountings as those previously described between mast 11 and the right side of boom 19 as viewed in FIG. 1. The dashpot would function similar to air dashpots used on conventional storm doors except that there would be no need for an internal return spring within the dashpot mechanism as is common practice with dashpots designed for conventional storm doors.

The present invention may use compression gas springs (not shown) to substitute or assist in providing counterbalancing force while providing built in damping in the event of an accidental release. These gas springs are commonly used for counterbalancing the hoods and rear hatches of automobiles and many have unidirectional damping which impedes the sudden lifting of the hood or rear hatches but does not impede closing. A compression gas spring (not shown) may be positioned on the left side and adjacent to mast 11 as described in FIG. 1 and would be pivotally connected to mast 11 and boom 19 above backrest pad 42 using suitable pivotal brackets (not shown). This arrangement, although perfectly operational, would place the gas spring in a position which its own weight does not produce counterbalancing force; however simply bending the mast to the right, just below the described bracket connecting the gas spring to mast 11, will result in a nearly vertical positioning of the gas spring with pivot shaft 12 repositioned to the right.

A bumper stop assembly described in FIG. 7 uses an elastomeric bumper 51 mounted on bracket 52, which is fastened using nuts and bolts 53 to the upper portion of mast 11 and would pass through holes in yoke assembly 28 and also secures yoke assembly 28 to mast 11. Boom 19 would impact elastomeric bumper 51 which would dissipate energy and reduce the peak impact force and prevent metal to metal collision in the event of accidental release of rope 22 shown in FIG. 1. Impact energy would be dissipated and stored both in bracket 52 and bumper 51.

Bumper 51 may use commercially available bumper stops made of synthetic rubber, polyurethane or butyl rubber or other suitable elastomeric materials. A bumper stop as described may also be used in combination with one or more of the damping means as previously described.

Rope loop 24 is preferably non metallic and light weight to preclude any damage or injury which might occur in the event of an accidental release of rope 22. Rope loop 24 is preferably made of an electrically non conductive material.

The foregoing description of the invention illustrates and describes the present invention. Additionally, the disclosure shows and describes only the preferred embodiments of the invention, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art. The embodiments described herein above are further intended to explain best modes known of practicing the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

I claim:

1. A device for use by an individual providing lifting force when using a hand held object comprising:

support means attached to harnessing means for connection to said individuals body wherein a portion of said support means extends from said harnessing means to a pivotal attachment with boom means for rotation of said boom means about said support means during manipulation of said hand held object;

coupling means attaching said object to a front portion of said boom means;

force producing means connected to said boom means and said support means whereby the weight of said object is at least partially offset by said force producing means.

2. The device as described in claim 1 wherein:

said support means includes a mast.

3. The device as described in claim 1 wherein force producing means further includes motion control means wherein:

the velocity of said boom is limited upon disconnection of said object connected to said boom.

4. The device as described in claim 3 wherein:

said motion control means includes damping means.

5. The device as described in claim 1 wherein:

said force producing means includes a spring.

6. The device as described in claim 1 wherein:

said force producing means includes a gas spring.

7. The device as described in claim 6 wherein:

said gas spring includes damping means.

8. The device as described in claim 1 wherein:

said harnessing means includes electrical insulating means between said support means and said individuals body.

9. The device as described in claim 1 wherein:

said boom means further includes motion amplifying means for increasing the distance said hand held object is lifted.

10. Apparatus for countering the weight of an implement held in the hands of a user comprising:

harness means worn by said user;

support means attached to said harness means having a portion extending from said harness means;

boom means pivotally attached to said extending portion of said support means for rotation of said boom means about said support means during movement of said implement;

coupling means attached to front portion of said boom means for attaching said implement to said boom;

force producing means connected to said boom means and said support means counteracting the weight of said implement during said movement.

11. The device as described in claim 10 wherein:

said support means includes a mast.

12. The device as described in claim 10 wherein force producing means further includes motion control means wherein:

the velocity of said boom is limited upon detachment of said implement connected to said boom.

13. The device as described in claim 12 wherein:

said motion control means includes damping means.

14. The device as described in claim 10 wherein:

said force producing means includes a spring.

15. The device as described in claim 10 wherein:

said force producing means includes a gas spring.

16. The device as described in claim 15 wherein:

said gas spring includes damping means.

17. The device as described in claim 10 wherein:

said harnessing means includes electrical insulating means between said support means and said individuals body.

18. The device as described in claim 10 wherein:

said boom means further includes motion amplifying means for increasing the distance said hand held implement is lifted.

* * * * *